US006457446B1

(12) United States Patent
Willmot

(10) Patent No.: US 6,457,446 B1
(45) Date of Patent: Oct. 1, 2002

(54) PHASE CONTROL MECHANISM

(75) Inventor: Eric Paul Willmot, Melba (AU)

(73) Assignee: Aimbridge Pty Ltd., Victoria (AU)

( * ) Notice: Subject to any disclaimer, the term of this patent is extended or adjusted under 35 U.S.C. 154(b) by 0 days.

(21) Appl. No.: 09/665,383

(22) Filed: Sep. 20, 2000

(30) Foreign Application Priority Data

Sep. 22, 1999 (AT) ..... PQ3021

(51) Int. Cl.[7] ..... F01L 1/34

(52) U.S. Cl. ..... 123/90.17; 123/90.15; 123/90.31; 475/170; 74/395

(58) Field of Search ..... 123/90.17, 90.15, 123/90.31, 90.6; 475/6, 332, 170, 178; 74/395, 665 GA, 665 GB, 665 GC, 117, 112

(56) References Cited

U.S. PATENT DOCUMENTS

| | | | | |
|---|---|---|---|---|
| 2,163,035 A | | 6/1939 | Grupe | |
| 2,759,494 A | | 8/1956 | Honegger | |
| 3,364,789 A | | 1/1968 | Whitfield | |
| 5,090,366 A | * | 2/1992 | Gondek | 123/90.17 |
| 5,125,372 A | * | 6/1992 | Gondek | 123/90.17 |
| 5,174,716 A | | 12/1992 | Hora et al. | |
| 5,361,736 A | * | 11/1994 | Phoenix et al. | 123/90.17 |
| 5,592,908 A | * | 1/1997 | Hara et al. | 123/90.17 |
| 5,606,941 A | | 3/1997 | Trzmiel et al. | |
| 5,685,794 A | * | 11/1997 | Willmot | 475/170 |
| 5,709,179 A | * | 1/1998 | Hara et al. | 123/90.15 |
| 6,122,984 A | * | 9/2000 | Willmot | 74/395 |
| 6,257,186 B1 | * | 7/2001 | Heer | 123/90.17 |
| 6,302,073 B1 | * | 10/2001 | Heer | 123/90.17 |
| 6,328,006 B1 | * | 12/2001 | Heer | 123/90.15 |
| 6,336,887 B1 | * | 1/2002 | Willmot | 475/178 |

FOREIGN PATENT DOCUMENTS

| | | |
|---|---|---|
| AU | 67443/94 | 1/1995 |
| EP | 0 396 280 | 4/1992 |
| GB | 531756 | 1/1941 |
| GB | 569056 | 5/1945 |
| GB | 627847 | 8/1949 |
| GB | 2 168 435 | 6/1986 |
| GB | 2 175 368 | 11/1986 |
| GB | 2 183 783 | 6/1987 |
| GB | 2 221 513 | 2/1990 |
| WO | WO 85/01490 | 4/1985 |
| WO | WO 87/03056 | 5/1987 |

* cited by examiner

*Primary Examiner*—Teresa Walberg
*Assistant Examiner*—Fadi H. Dahbour

(57) ABSTRACT

A phase control mechanism for adjusting the phase relationship between a cam shaft and a crank shaft and an internal combustion engine is disclosed, to enable variable valve timing within the engine. The mechanism is disposed between crank shaft (203) and cam shaft (202) and comprises a pulley (204) which is integrally connected to a bevel gear (216). Bevel gears (224) are supported in the cage (220) which is integrally coupled to the cam shaft (202). A control gear (210) meshes with the bevel gears (224) and the control gear (210) is connected to a shaft (208) which may be driven by a stepper motor (215) which drives the shaft (208) via a gear (209). Rotation of the gear (210) causes the gears (224) to advance or regress relative to the gear (214) and therefore relative to the pulley (204) and crank shaft (203) so as to change the valve timing of the engine.

11 Claims, 2 Drawing Sheets

PHASE CONTROL MECHANISM

BACKGROUND OF THE INVENTION

This invention relates to a phase control mechanism for controlling a predetermined phase relationship of at least one output, and in particular to such a mechanism used in an internal combustion engine for variable valve timing.

Many situations exist in industry and transport where it is necessary to be able to alter the phase relationship between concentric rotating shafts, parallel shafts or other similar elements while they are in motion and under load.

Examples of this need, include the control of the pitch of propellers of aircraft and boats, particularly ships; controlling the pitch of power producing windmills; opening and closing lathe and drill chucks while they are in motion during production runs; controlling the eccentricity of some forms of continuously variable transmissions and determining the valve timing of cam shafts in internal combustion engines.

Operations of the type mentioned above is usually achieved by using electric devices or sliding mechanical mechanisms. These mechanisms all have difficulty with high levels of torque, and in general, with reliability.

A need therefore exists for a mechanical rotating mechanism which is able to alter the phase relationship between two or more concentric or parallel shafts while they are in motion and under load.

SUMMARY OF THE INVENTION

The invention may therefore be said to reside in a phase control mechanism for controlling the phase relationship between an input supply and an output, including:

a drive member for coupling with the input supply so as to be driven by the input supply;

at least one first gear coupled to the drive member;

an output element for coupling with the output to provide drive to the output;

at least one second gear in driving engagement with the at least one first gear;

a phase adjusting member;

at least one gear coupled with the phase adjusting member and engaging with the at least one second gear; and wherein to drive the output, the input supply supplies drive to the drive member to in turn drive the output element and therefore the output via the at least one first gear and the at least one second gear and in order to alter the phase relationship between the input supply and the output, the phase adjustment member is adjusted so that the phase adjusting gear causes the at least one second gear to advance or regress relative to the at least one first gear to thereby change the phase relationship between the output and the drive member and therefore the phase relationship between the input supply and the output.

A further aspect of the invention is specifically directed to controlling the phase relationship between an engine crank shaft and an engine cam shaft to change the cam timing of the engine during operation of the engine.

Mechanisms are known for controlling cam timing to alter the timing of a valve opening in an engine. Such mechanisms generally employ sliding elements and also chains for causing the phase change to occur.

The object of this aspect of the invention is to provide an improvement over those known mechanisms.

The invention may be said to reside in an internal combustion engine including;

a crank shaft for supplying rotary power;

at least one cam shaft for opening and closing valves in the internal combustion engine;

a phase control mechanism coupled between the crank shaft and the at least one cam shaft and having;

(a) a first gear member coupled to the cam shaft;

(b) drive means for transmitting rotary power from the crank shaft to the cam shaft to rotate the cam shaft when the crank shaft rotates;

(c) a phase adjusting means for causing the first gear member to advance or regress; and means for actuating the phase adjusting means to thereby cause the first gear member to advance or regress to change the phase relationship between the crank shaft and the cam shaft.

Thus, by adjusting the phase adjustment member in an internal combustion engine using the phase control mechanism to control a cam shaft, the phase of the cam shaft relative to the crank shaft of the engine can be adjusted to thereby control the valve time opening during operation of the engine.

Preferably, the input supply comprises a crank shaft of an internal combustion engine and the output comprises a cam shaft in the engine.

Preferably, the drive member is coupled to the crank shaft by gears or by a cam chain for driving the drive member to in turn rotate the cam shaft.

Preferably, the phase adjusting member has actuating means for rotating the phase adjustment member to change the phase relationship between the cam shaft and the crank shaft of the engine.

Preferably, the at least one first gear comprises a bevel gear coupled to the drive member.

Preferably, the at least one second gear comprises a pair of bevel gears rotatably supported on shafts coupled to the output member and preferably the phase adjustment gear comprises a bevel gear meshing with the at least two bevel gears coupled to the output element.

Preferably, the output element comprises a planet cage formed integral with the output.

The invention may also be said to reside in a phase control mechanism for an internal combustion engine for changing the timing between a cam shaft of the internal combustion engine and a crank shaft of the internal combustion engine to thereby vary valve timing within the internal combustion engine, said mechanism including;

a planet cage connectable to the cam shaft;

at least one first bevel gear carried by the planet cage;

an input element couplable to the crank shaft for rotation by the crank shaft;

a second bevel gear carried by the input element and meshing with the first bevel gear carried by the planet cage;

a third bevel gear meshing with the first bevel gear carried by the planet cage;

a phase adjusting means connected to the third bevel gear;

wherein when the mechanism is installed in the engine and the crank shaft is rotated rotation is supplied to the input element to in turn rotate the second bevel gear carried by the input element and the first bevel gear carried by the planet cage so that the planet cage rotates to in turn rotate the cam shaft, and wherein to change the phase relationship and therefore valve timing of the engine, the phase adjusting means is actuated to rotate the third bevel gear so as to advance or regress the first bevel gear connected to the planet cage to advance or regress the planet cage and therefore the cam shaft relative to the crank shaft.

Preferably the phase adjusting mechanism comprises a shaft connected to the third bevel gear, and an actuator for rotating the shaft to in turn rotate the third bevel gear.

Preferably the phase adjusting means maintains the third bevel gear stationary when the cam shaft is required to rotate in phase with the crank shaft.

A still further aspect of the invention provides a clutch mechanism for use with a phase controller for selectively shutting off drive to an output. This aspect of the invention may be said to reside in a clutch mechanism for a phase control mechanism, including:

an input;

an output;

phase control means between the input and the output for controlling a phase relationship;

a rotary member for rotation with the phase control member; and stop means for selectively stopping rotation of the rotary member so that drive is transmitted to the output for releasing the rotary member for rotation so drive is transmitted to the rotary member rather than to the output to provide a clutching operation between the input and the output.

Preferably, the rotary member comprises a disc and the stop means comprises a disc brake arrangement.

BRIEF DESCRIPTION OF THE DRAWINGS

Preferred embodiments of the invention will be described, by way of example, with reference to the accompanying drawings in which.

DETAILED DESCRIPTION OF THE PREFERRED EMBODIMENTS

Figure 1:
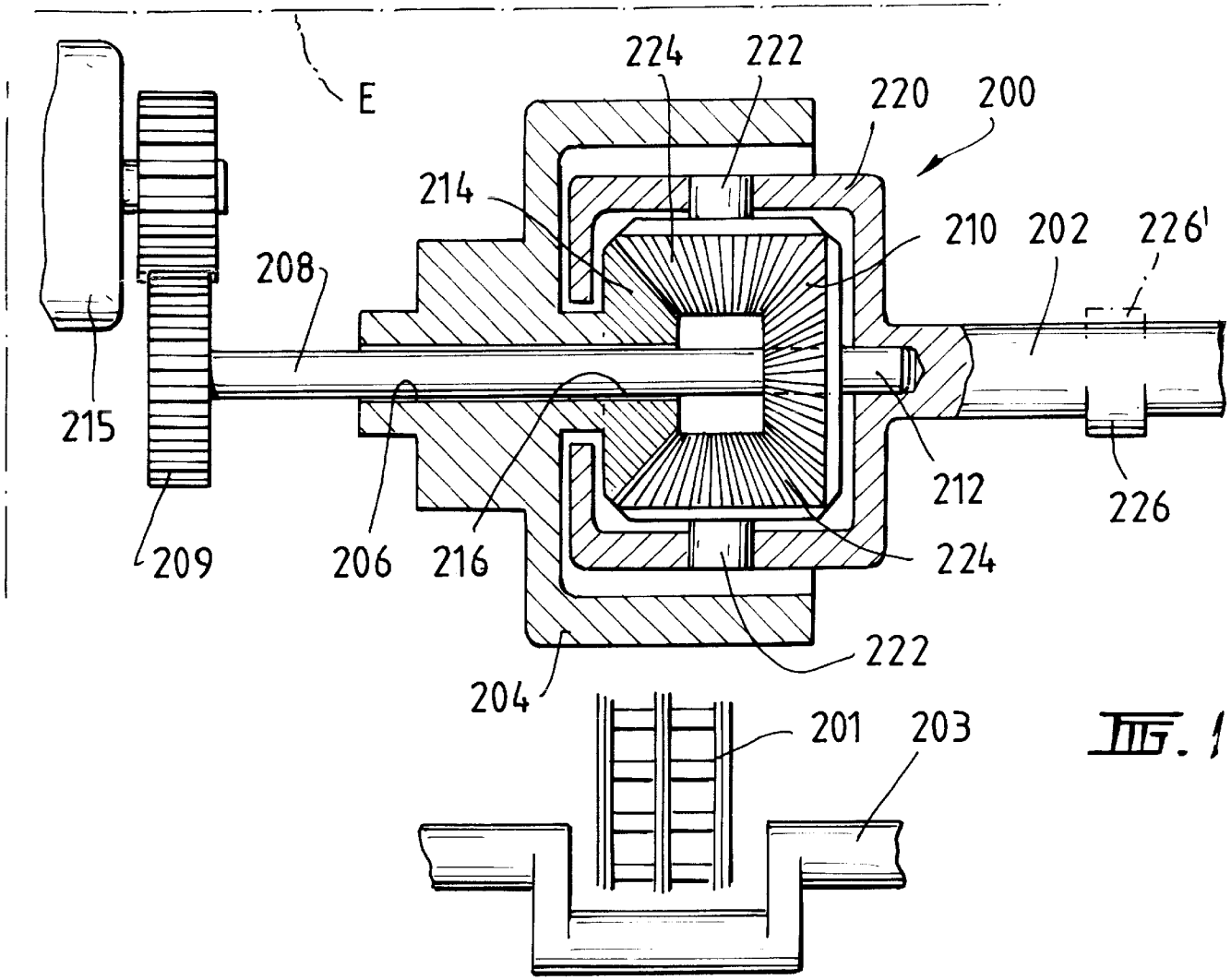
FIG. 1 is a view of a phase control mechanism particularly suited for controlling a cam shaft in an engine.

With reference to FIG. 1, which shows a phase controller 200 which is particularly suited to controlling the timing of a cam shaft 202 which may be used in an internal combustion engine E.

The phase controller 200 has a pulley 204 which is adapted to be driven by a cam chain 201 from a crank shaft 203 of an internal combustion engine (not shown). The cam chain 201 and the crank shaft 203 are only schematically shown in FIG. 1 for illustration purposes. The pulley 204 may have sprocket elements (not shown), grooves or the like (not shown) for coupling the cam chain to the pulley 204 so that the pulley 204 will be rotated with rotation of the crank shaft of the engine.

The pulley 204 has a central bore 206 which receives a control shaft 208, the control shaft 208 carries an integral bevel gear 210 and has a stub portion 212 at one end.

The pulley 204 also has an integral bevel gear 214. The bevel gear 214 is provided with a bore 216 which is a continuation of the bore 206 for accommodating the shaft 208.

The cam shaft 202 has a cage portion 220 at one end which supports shafts 222 upon which bevel gears 224 are mounted. The bevel gears 224 mesh with the bevel gears 210 and 214 as shown in FIG. 1.

The cam shaft 202 may have cams 226 arranged thereon as is conventional for opening valves (not shown) of the internal combustion engine and allowing the valves to close as the cam shaft 202 rotates.

When the internal combustion engine with which the phase controller 200 is fitted is in operation, drive is transmitted from the crank shaft to the pulley 204 so that the pulley 204 is rotated to thereby cause the cage 220 and therefore the cam shaft 202 to rotate by virtue of the interengagement of the gear 214 with the gears 224. Thus, the cam shaft 202 is rotated to open and close the valves of the engine associated with that cam shaft. If it is desired to alter the valve timing so that the valves open and close with a different timing, the adjustor shaft 208 is rotated about its axis so as to rotate the bevel gear 210. This causes the bevel gears 224 to advance or regress relative to the bevel gear 214 whilst the bevel gear 214 and therefore the cage 220 and cam shaft 202 is rotating so that the effective phase relationship between the cam shaft 202 and the pulley 204 is altered to thereby change the timing at which the cam element 226 will open valves of the internal combustion engine and allow the valves to close. Thus, the valve timing can be adjusted by simply adjusting the adjuster shaft 208.

The adjustment may be a complete 360° relative rotation of the shaft 202 relative to the pulley 204 which provides an extremely large range of phase adjustment of the shaft 202 relative to the pulley 204. In most valve timing operations, only a phase change of from 10 to 30° may be required. However, the ability to make a complete 360° phase shift between the shaft 202 and pulley 204 does have advantages in that the cam 226 may be provided with a different shaped cam profile 226' offset with respect to the cam element 226 by an amount of 180° so that if desired, the shaft 202 could be phase shifted relative-to the pulley 204 by an amount of 180° so that the profile 226' does the valve opening at the appropriate time for exhaust of gasses from the cylinders of the internal combustion engine. Thus, a different cam profile can be used for different engine operation characteristics by adjustment of the adjuster shaft 208.

The shaft 208 can be adjusted by a gear 209 mounted on the shaft 208, which can be driven from a stepper motor 215 or other drive element which can be controlled automatically in response to engine revolutions or other parameters of the engine or manually by the driver adjusting appropriate control switches or knobs in the vehicle.

Figure 2:
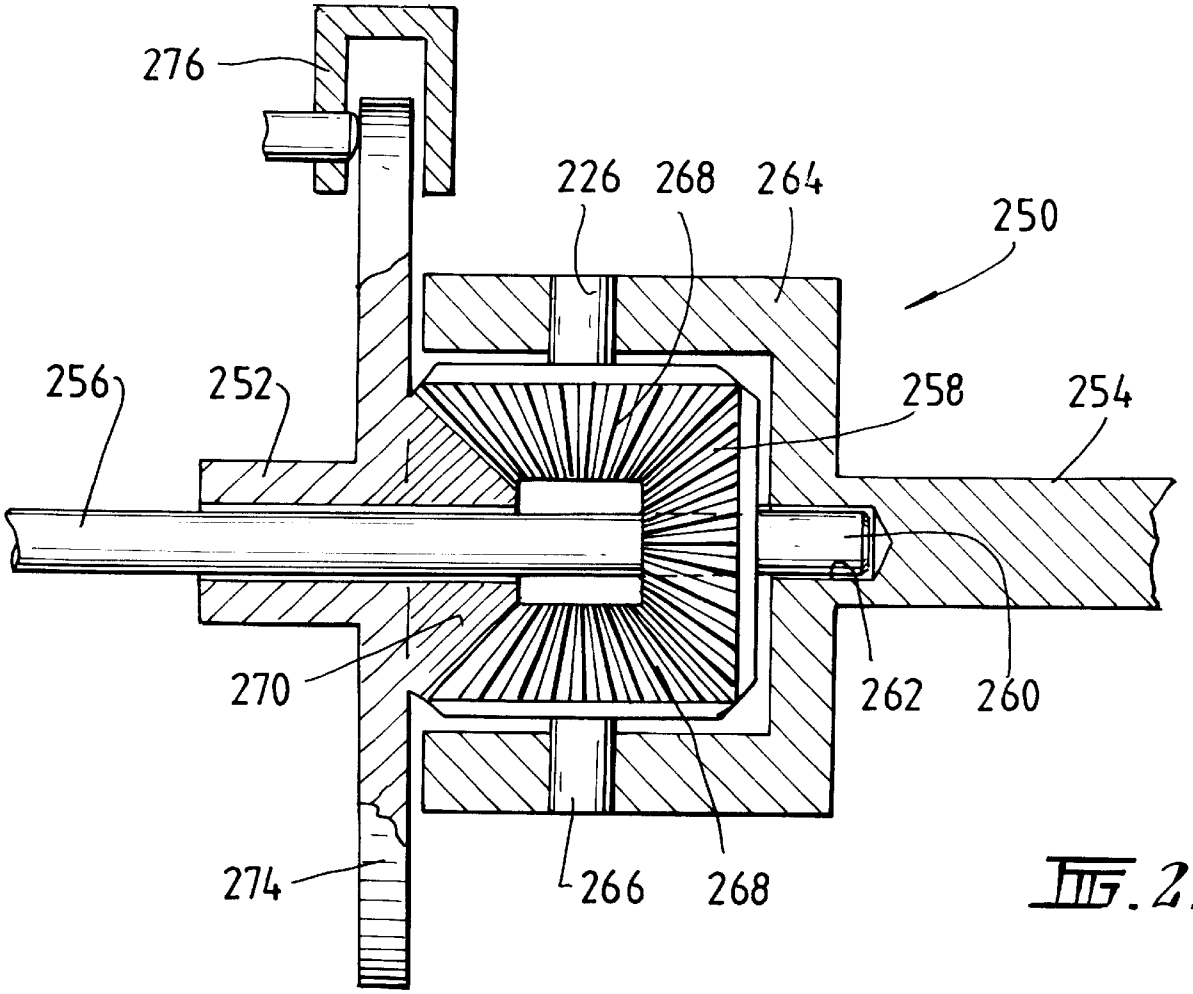
FIG. 2 is a view of a clutch arrangement for a phase control mechanism.

FIG. 2 shows a clutch mechanism for controlling output drive through a phase controller. In this embodiment, the phase controller 250 is similar to the phase controller described with reference to FIG. 1. However, this phase controller is merely used for illustrative purposes and normally a clutch mechanism would not be utilised with a cam shaft because normally it would not be desired to stop motion of the cam shaft during operation of the engine.

In this embodiment, the phase controller controls the phase relationship between the shaft 252 and the output shaft 254. An input shaft 256 is arranged with the shaft 252 and carries an integral bevel gear 258. The shaft 256 has a stub 260 at its end which is journalled for rotation within a recess 262 in a planet cage 264. The output shaft 254 is integral with the planet cage 264 as shown in FIG. 2. The planet cage 264 carries shafts 266, each of which has a bevel gear 268.

The shaft 252 also has an integral bevel gear 270 and the bevel gear 270 me she s with the bevel gears 264 and the bevel gears 264 mesh with the bevel gear 258 as shown.

The shaft 252 carries a disc 274 which may be integral with the shaft 252 and bevel gear 270. Arranged at the periphery of the disc 274 is a disc control 276 which may be in the form of a disc brake arrangement or the like.

When drive is applied to the input shaft 256 and the disc 274 is free to rotate, drive is merely transmitted via the bevel gears 268 and bevel gear 270 to the shaft 252 and the output shaft 254 remains stationary.

However, when the disc brake arrangement 276 is actuated to stop rotation of the disc 274, drive is transmitted to the planet cage 264 and to the shaft 254 for driving the shaft 254.

The phase relationship between the shaft 252 and the shaft 254 can be adjusted during operation by simply driving the shaft 252 by a gear or the like so that the bevel gear 270 advances or regresses relative to the gears 268 and 258 to change the phase relationship between the shaft 252 and 254. It is desired to completely shut off drive to the shaft 254, the disc controller 276 is simply opened to allow the disc 274 to rotate so that the drive is transferred from the shaft 254 to the disc 252.

In the preferred embodiments of the invention described above, the phase relationship between two output shafts is adjusted. It would also be possible to alter the phase relationship between more than two output shafts by adding additional output shafts concentric with the output shafts 1*a* and 2 and duplicating the mechanism described above so that there would be a series of yokes 10 or moveable orbit gears 17 which can be adjusted to alter the phase relationship between three or more shafts.

Since modifications within the spirit and scope of the invention may readily be effected by persons skilled within the art, it is to be understood that this invention is not limited to the particular embodiment described by way of example hereinabove.

The claims defining the invention are as follows:

1. A phase control mechanism for controlling the phase relationship between an input supply and an output, including:

a drive member for coupling with the input supply so as to be driven by the input supply;

at least one first gear coupled to the drive member;

an output element for coupling with the output to provide drive to the output;

at least one second gear in driving engagement with the at least one first gear;

a phase adjusting member;

at least one gear coupled with the phase adjusting member and engaging with the at least one second gear; and wherein to drive the output, the input supply supplies drive to the drive member to in turn drive the output element and therefore the output via the at least one first gear and the at least one second gear and in order to alter the phase relationship between the input supply and the output, the phase adjustment member is adjusted so that the phase adjusting gear causes the at least one second gear to advance or regress relative to the at least one first gear to thereby change the phase relationship between the output and the drive member and therefore the phase relationship between the input supply and the output.

2. The phase control mechanism of claim 1 wherein the input supply comprises a crank shaft of an internal combustion engine and the output comprises a cam shaft in the engine.

3. The phase control mechanism of claim 2 wherein the drive member is coupled to the crank shaft by gears or by a cam chain for driving the drive member to in turn rotate the cam shaft.

4. The phase control mechanism of claim 2 wherein the phase adjusting member has actuating means for rotating the phase adjustment member to change the phase relationship between the cam shaft and the crank shaft of the engine.

5. The phase control mechanism of claim 1 wherein the at least one first gear comprises a bevel gear coupled to the drive member.

6. The phase control mechanism of claim 1 wherein the at least one second gear comprises a pair of bevel gears rotatably supported on shafts coupled to the output element and the phase adjustment gear comprises a bevel gear meshing with the at least two bevel gears coupled to the output element.

7. The phase control mechanism of claim 1 wherein the output element comprises a planet cage formed integral with the output.

8. A phase control mechanism for an internal combustion engine for changing the timing between a cam shaft of the internal combustion engine and a crank shaft of the internal combustion engine to thereby vary valve timing within the internal combustion engine, said mechanism including;

a planet cage connectable to the cam shaft;

at least one first bevel gear carried by the planet cage;

an input element couplable to the crank shaft for rotation by the crank shaft;

a second bevel gear carried by the input element and meshing with the first bevel gear carried by the planet cage;

a third bevel gear meshing with the first bevel gear carried by the planet cage;

a phase adjusting means connected to the third bevel gear;

wherein when the mechanism is installed in the engine and the crank shaft is rotated rotation is supplied to the input element to in turn rotate the second bevel gear carried by the input element and the first bevel gear carried by the planet cage so that the planet cage rotates to in turn rotate the cam shaft, and wherein to change the phase relationship and therefore valve timing of the engine, the phase adjusting means is actuated to rotate the third bevel gear so as to advance or regress the first bevel gear connected to the planet cage to advance or regress the planet cage and therefore the cam shaft relative to the crank shaft.

9. The phase control mechanism according to claim 8 wherein the phase adjusting means comprises a shaft connected to the third bevel gear, and an actuator for rotating the shaft to in turn rotate the third bevel gear.

10. The phase control mechanism of claim 8 wherein the phase adjusting means maintains the third bevel gear stationary when the cam shaft is required to rotate in phase with the crank shaft.

11. An internal combustion engine including;

a crank shaft for supplying rotary power;

at least one cam shaft for opening and closing valves in the internal combustion engine;

a phase control mechanism coupled between the crank shaft and the at least one cam shaft and having;

(a) a first gear member coupled to the cam shaft;

(b) drive means for transmitting rotary power from the crank shaft to the cam shaft to rotate the cam shaft when the crank shaft rotates;

(c) a phase adjusting means for causing the first gear member to advance or regress; and means for actuating the phase adjusting means to thereby cause the first gear member to advance or regress to change the phase relationship between the crank shaft and the cam shaft.

* * * * *